US012778246B2

(12) United States Patent
Goodwin

(10) Patent No.: US 12,778,246 B2
(45) **Date of Patent: *Nov. 3, 2026**

(54) HYBRID RING

(71) Applicant: Groove Life Corporation, Spring Hill, TN (US)

(72) Inventor: Peter M. Goodwin, Spring Hill, TN (US)

(73) Assignee: Groove Life Corporation, Spring Hill, TN (US)

( * ) Notice: Subject to any disclaimer, the term of this patent is extended or adjusted under 35 U.S.C. 154(b) by 60 days.

This patent is subject to a terminal disclaimer.

(21) Appl. No.: 19/011,304

(22) Filed: Jan. 6, 2025

(65) Prior Publication Data

US 2025/0134218 A1 May 1, 2025

Related U.S. Application Data

(63) Continuation of application No. 18/092,381, filed on Jan. 2, 2023, now Pat. No. 12,185,801, which is a continuation of application No. 17/161,994, filed on Jan. 29, 2021, now abandoned, which is a continuation of application No. 16/866,998, filed on May 5, 2020, now Pat. No. 10,932,533.

(51) Int. Cl.
*A44C 9/00* (2006.01)

(52) U.S. Cl.
CPC ..... *A44C 9/0007* (2013.01)

(58) Field of Classification Search
CPC ..... A44C 5/0084; A44C 5/0092; A44C 9/00; A44C 9/0038; A44C 9/0007; A44C 9/0015; A44C 9/0023
USPC ..... 63/15, 15.7
See application file for complete search history.

(56) References Cited

U.S. PATENT DOCUMENTS

| | | | | |
|---|---|---|---|---|
| 2013/0091895 | A1* | 4/2013 | Hwang | A44C 9/02 63/15.1 |
| 2018/0035768 | A1* | 2/2018 | Goodwin | A44C 9/00 |
| 2020/0077752 | A1* | 3/2020 | Junkins | A44C 9/0038 |

* cited by examiner

*Primary Examiner* — Jack W Lavinder
(74) *Attorney, Agent, or Firm* — Billion & Armitage

(57) ABSTRACT

A ring for wearing by a user may include a rigid outer annular body and a flexible inner annular body. The outer annular body may be a rigid material, and the inner annular body may be flexible and formed from an injection molded process. The outer annular body may be attached to the inner annular body. The inner annular body may be machined to curve from longitudinal ends of the inner annular body to an inner surface after the inner annular body is joined to the outer annular body in order to provide a comfort fit. The inner annular body may be molded with the comfort fit curvature. The outer annular body may have at least one strain relief recess in an inner surface thereof, and the inner annular body may fill the at least one strain relief recess.

18 Claims, 4 Drawing Sheets

HYBRID RING

CROSS REFERENCE TO RELATED APPLICATIONS

This application is a continuation of U.S. application Ser. No. 18/092,381, titled "Hybrid Ring," filed on Jan. 2, 2023, now U.S. Pat. No. 12,185,801; which is a continuation of U.S. application Ser. No. 17/161,994, titled "Hybrid Ring," filed on Jan. 29, 2021; which is a continuation of U.S. application Ser. No. 16/866,998, titled "Hybrid Ring," filed on May 5, 2020, now U.S. Pat. No. 10,932,533. This application incorporates the entire contents of the foregoing applications herein by reference.

TECHNICAL FIELD

Various implementations relate generally to wearable rings, particularly safety rings with break-away features.

BACKGROUND

Traditional rings are typically made of titanium, stainless steel, carbon fiber, gold, platinum, silver, or other precious metals. These materials are often chosen due to both appearance and durability. However, due to their inherent strength, metal rings (and carbon fiber rings) are the source of many injuries. More specifically, in the unfortunate event that a user catches his or her metal ring on something, it can cause bruising, avulsion, or even amputation of the associated digit. This problem is particularly prevalent for machinists, construction workers, athletes, and other physically active individuals.

In an attempt to avoid injury, it has been suggested that individuals wear their rings on a chain around their neck. While this would protect the individual's finger or toe, most people are not interested in permanently converting their ring into a necklace. Further, it is not practical to remove one's ring every time the wearer is switching from an activity that will not result in injury to an activity that could result in injury and replace the ring when the dangerous activity ends. Silicone rings have become an alternative to metal rings for wearers who routinely engage in activities that could result in injury if the user is wearing a ring. Silicone rings are disclosed in U.S. Pat. No. 10,383,412 entitled "VENTED RING AND METHOD OF MANUFACTURING THE SAME", the disclosure of which is hereby incorporated by reference. Although silicone rings have the potential to reduce injury, they do not have the same aesthetic as the metals and other rigid materials that they replace. Silicone rings have become common for athletes and industrial or construction workers, but most office workers still wear metal rings (or other rigid material rings) even though many of these people will occasionally engage in activities dangerous to people wearing rings. A safer ring with the look of rigid materials is therefore desirable.

SUMMARY

Aspects include a ring with a rigid outer annular body and a flexible inner annular body. In one embodiment, the outer annular body is a rigid material formed from a process other than injection molding, and the inner annular body is flexible and formed from an injection molded process. The outer annular body is attached to the inner annular body. The inner annular body may be machined to curve from longitudinal ends of the inner annular body to an inner surface of the inner annular body after the inner annular body is joined to the outer annular body in order to provide a comfort fit. Alternatively, the inner annular body may be molded with the comfort fit curvature. In one embodiment, the outer annular body has at least one strain relief recess in an inner surface thereof, and the inner annular body fills the at least one strain relief recess.

In one aspect, a ring configured to be worn by a user includes an outer annular body and an inner annular body. The inner annular body is formed via an injection molding process. The outer surface of the inner annular body is attached to an inner surface of the outer annular body. The inner surface of the inner annular body is configured to contact the user when the ring is worn by the user.

In another aspect, a ring configured to be worn by a user includes an outer annular body and an inner annular body. The inner annular body is formed via an injection molding process. The outer surface of the inner annular body is attached to an inner surface of the outer annular body. The inner surface of the inner annular body is configured to contact the user when the ring is worn by the user. The outer annular body is not formed via an injection molding process.

In another aspect, a ring configured to be worn by a user includes an outer annular body and an inner annular body. The inner annular body is formed via an injection molding process. The outer surface of the inner annular body is attached to an inner surface of the outer annular body. The inner surface of the inner annular body is configured to contact the user when the ring is worn by the user. The outer annular body includes at least one strain relief recess in an inner surface of the outer annular body. The inner annular body extends into the strain relief recess in the outer annular body.

BRIEF DESCRIPTION OF THE DRAWINGS

Reference will now be made in detail to optional embodiments, examples of which are illustrated in accompanying drawings. Whenever possible, the same reference numbers are used in the drawing and in the description referring to the same or like parts.

DETAILED DESCRIPTION

While the making and using of various embodiments are discussed in detail below, it should be appreciated that many applicable concepts that can be embodied in a wide variety of specific contexts. The specific embodiments discussed herein are merely illustrative of specific ways to make and use such embodiments and do not delimit the scope thereof.

To facilitate the understanding of the embodiments described herein, a number of terms are defined below. The terms defined herein have meanings as commonly understood by a person of ordinary skill in the areas relevant to the various embodiments. Terms such as "a," "an," and "the" are not intended to refer to only a singular entity, but rather include the general class of which a specific example may be used for illustration. The terminology herein is used to describe specific embodiments, but their usage does not delimit such embodiments, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. As used herein, the upright position of a ring is when worn on the finger of a user and the finger is generally horizontal such that the ring is annular about a horizontally extending longitudinal axis. The term "when" is used to specify orientation for relative positions of components, not as a temporal limitation of the claims or apparatus described and claimed herein unless otherwise specified. The terms "above," "below," "over," and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

Figure 1:
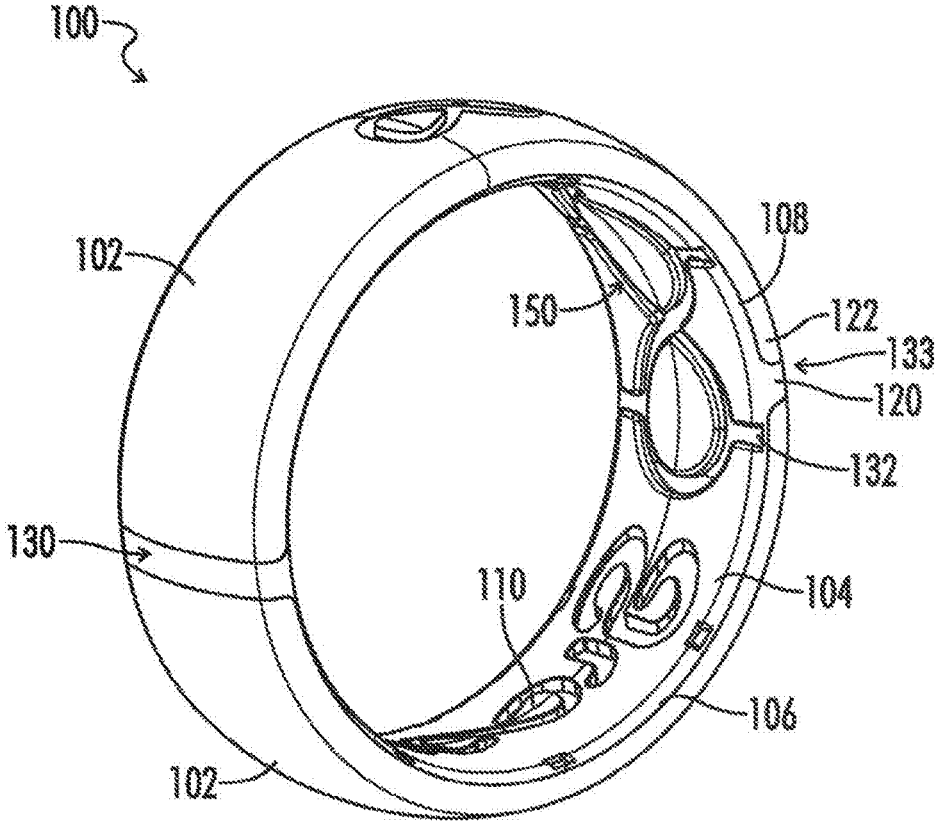
FIG. 1 is an isometric view of a ring according to one embodiment.
Figure 2:
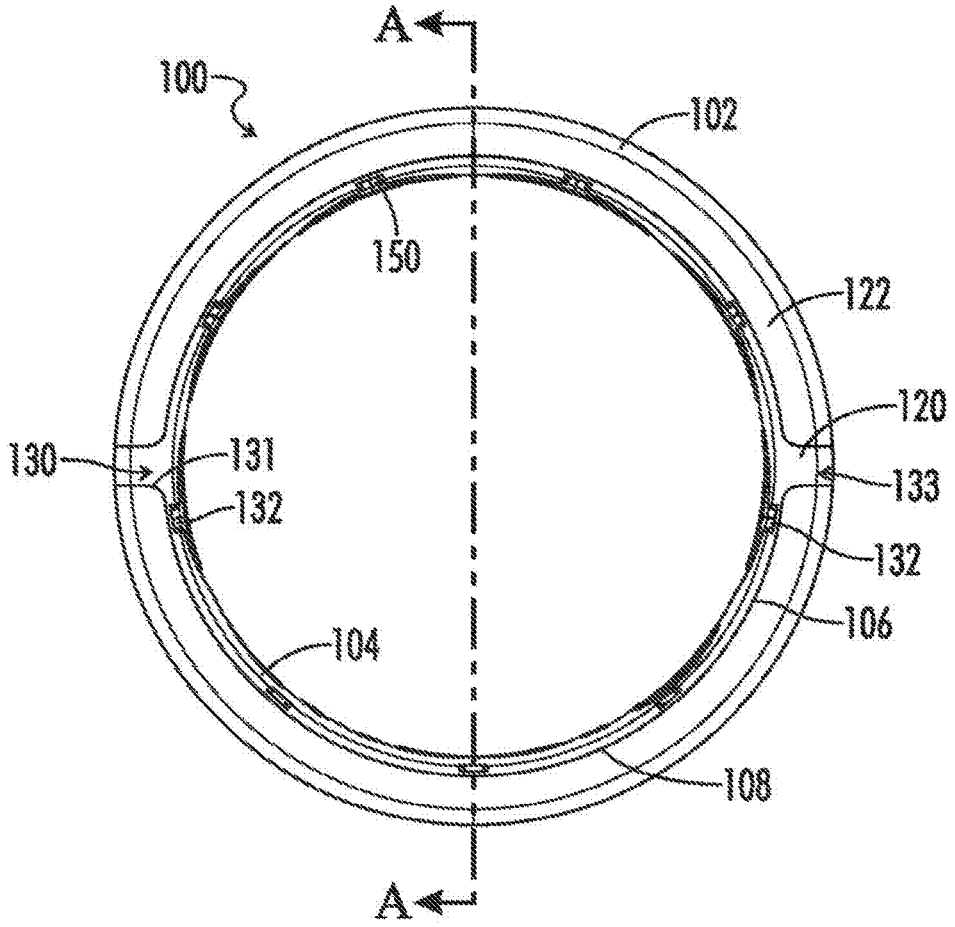
FIG. 2 is a rear perspective view of the ring of FIG. 1.
Figure 3:
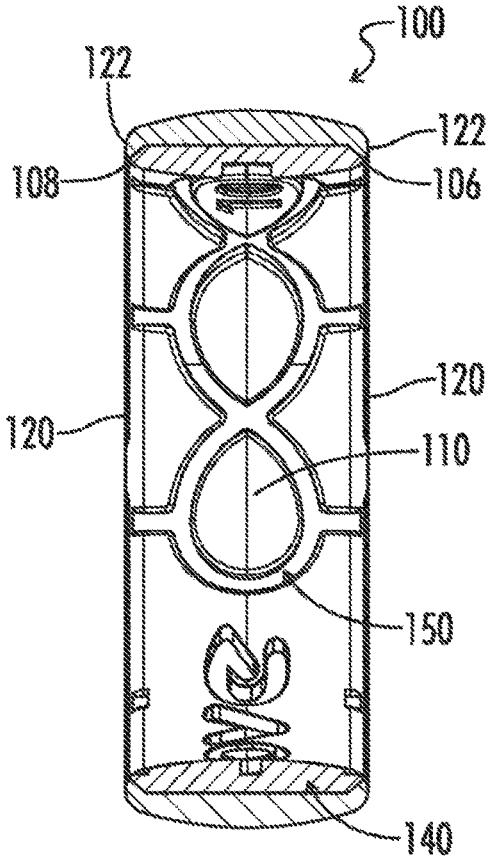
FIG. 3 is a cutaway view of the ring of FIG. 2 shown along plane A in FIG. 2.
Figure 4:
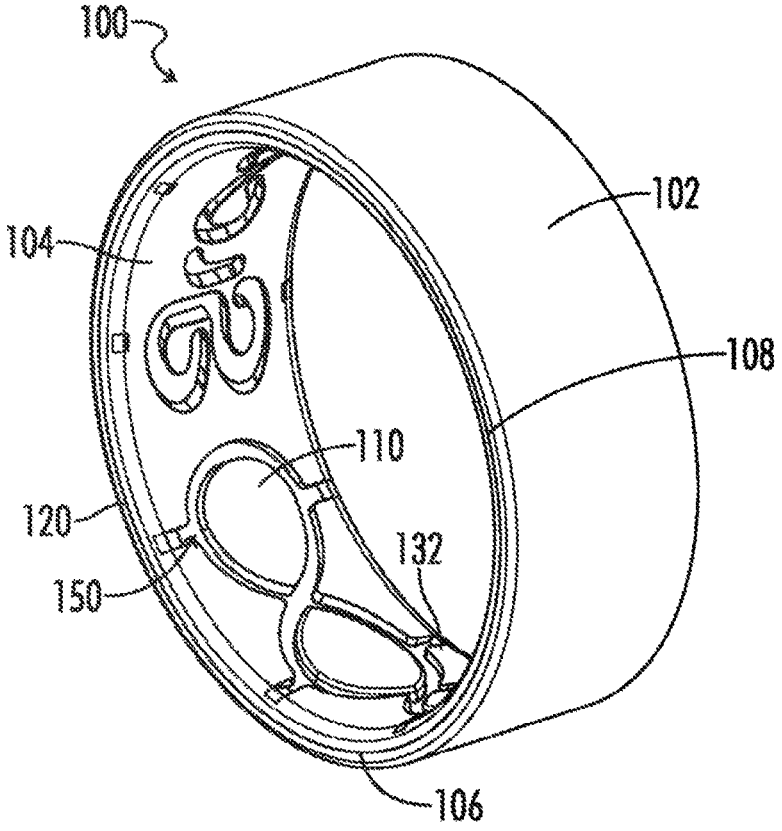
FIG. 4 is an isometric view of a ring according to one embodiment.

Referring to FIGS. 1-4, a ring 100 is configured to be worn about a finger of a user. The ring 100 includes an outer annular body 102 and an inner annular body 104. The inner annular body 104 is formed via an injection molding process. An outer surface 106 of the inner annular body 104 is attached to an inner surface 108 of the outer annular body 102. An inner surface 110 of the inner annular body 104 is configured to contact the finger of the user when the ring 100 is worn by the user.

The outer annular body 102 may be formed via a number of different processes depending on the material of the outer annular body 102. In one embodiment, the outer annular body 102 is formed of a material from the group of materials consisting of gold, titanium, carbon fiber, and stainless steel. It is contemplated within the scope of the claims that the material of the outer annular body 102 may be other than these materials. In one embodiment, the outer annular body 102 is not formed via an injection molding process. In one embodiment, the outer annular body 102 is not flexible, and instead, the outer annular body 102 is rigid.

The inner annular body 104 is formed via an injection molding process. In one embodiment, the material of the inner annular body 104 is flexible. In one embodiment, the inner annular body 104 is formed from silicone. In another embodiment, the inner annular body includes at least one of polyvinyl chloride, thermoplastic polyurethane, or silicone.

In one embodiment, the outer annular body 102 is placed into the mold which forms the inner annular body 104 during the injection molding process in order to bind the inner annular body 104 to outer annular body 102 and such that the inner annular body 104 fills any recesses or strain relief areas in the outer annular body 102. In one embodiment, the inner annular body 104 is machined after the injection molding process forming the inner annular body 104 to remove material from the inner annular body 104 such that longitudinal ends 120 of the inner annular body 104 do not extend beyond corresponding longitudinal ends 122 of the outer annular body 102. In one embodiment, the machining further rounds the inner annular body 104 such that the inner annular body 104 is rounded from the outer surface 106 of the inner annular body 104 to the inner surface 110 of the inner annular body 104. The machining may also remove material from the outer annular body 102 at the longitudinal ends 122 of the outer annular body 102 to better align the ends 120 of the inner annular body 104 with the longitudinal ends 122 of the outer annular body 102. In another embodiment, curvature of the inner annular body 104 from the outer surface 106 of the inner annular body to the inner surface 110 of the inner annular body 104 is accomplished during the injection molding process forming the inner annular body 104.

In one embodiment, the outer annular body 102 includes at least one strain relief recess 130 in the inner surface 108 of the outer annular body 102. The inner annular body 104 extends into the strain relief recess 130 in the outer annular body 102. In one embodiment, the strain relief recess 130 extends through the outer annular body 102 such that the outer annular body 102 is not continuous. In one embodiment, the inner annular body 104 includes a groove 132 corresponding to the strain relief recess 130 in the outer annular body 102. The groove 132 corresponding to the strain relief recess 130 may be angularly aligned with the strain relief recess 130, or may be slightly offset from the strain relief recess 130. That is, the groove 132 corresponding to the strain relief recess 130 may be angularly aligned at an edge 131 of the strain relief recess 130 or offset from the strain relief recess 130 by a small amount (e.g., less than 15°). In one embodiment, the outer annular body includes a plurality of strain relief recesses 130. The first strain relief recess 130 and a second strain relief recess 133 are opposite one another with respect to an angular location of each of the strain relief recesses such that the angle between the first strain relief recess 130 and the second strain relief recess 133 relative to a longitudinal axis through the center of the ring 100 is 180°. These strain relief recesses 130 and the corresponding grooves 132 are configured to create a weak point in the ring 100 such that if a user catches the ring on an object, the inner annular body 104 will tear through, removing the ring 100 from the user instead of injuring the user's finger.

In one embodiment, the outer annular body 102 has a fastening channel 140 defined therein. The fastening channel 140 is recessed from the inner surface 108 of the outer annular body 102, and the inner annular body 104 extends into the fastening channel 140 (see e.g., FIG. 2). In one embodiment, the inner annular body 104 substantially fills the fastening channel 140. The outer annular body 102 has a larger diameter in the fastening channel 140 than at the inner surface 108 of the outer annular body 102.

In one embodiment, the inner annular body 104 includes a plurality of slots 150 defined in the inner surface 110 of the inner annular body 104. Each of the slots 150 extends longitudinally from a first side of the ring 102 a second side of the ring 100 (e.g., between the opposing longitudinal ends 120 of the inner annular body 104). In one embodiment, the slots 150 do not extend directly from one side of the ring 100 to the opposing side of the ring 100, but instead are curved and interlinked with one another.

This written description uses examples to disclose the various embodiments and also to enable any person skilled in the art to practice the embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations. The principal features may be employed in various embodiments without departing from the scope thereof. Those of ordinary skill in the art will recognize numerous equivalents to the specific procedures described herein. Such equivalents are considered to be within the scope and are covered by the claims.

All of the compositions and/or methods disclosed and claimed herein may be made and/or executed without undue experimentation in light of the present disclosure. While the compositions and methods have been described in terms of the embodiments included herein, it will be apparent to those of ordinary skill in the art that variations may be applied to the compositions and/or methods and in the steps or in the sequence of steps of the method described herein without departing from the concept, spirit, and scope. All such similar substitutes and modifications apparent to those skilled in the art are deemed to be within the spirit, scope, and concept as defined by the appended claims.

Thus, although there have been described particular embodiments of a new and useful HYBRID RING, it is not intended that such references be construed as limitations upon the scope except as set forth in the following claims.

What is claimed is:

1. A ring configured to be worn by a user comprising:

an outer annular body that (a) is formed of a material from the group of materials consisting of gold, titanium, carbon fiber, and stainless steel; (b) comprises at least a first segment and a second segment that is physically distinct from the first segment; and (c) has an outer-body inner surface and an outer-body outer surface; and an inner annular body formed via an injection molding process;

wherein an outer surface of the inner annular body is attached to the outer-body inner surface; an inner surface of the inner annular body is configured to contact the user when the ring is worn by the user and comprises a plurality of slots that are curved and interlink with one another; and a portion of the inner annular body extends between the first segment and the second segment and to the outer-body outer surface.

2. The ring of claim 1, wherein the inner annular body is machined after the injection molding process forming the inner annular body to remove material from the inner annular body such that longitudinal ends of the inner annular body do not extend beyond corresponding longitudinal ends of the outer annular body.

3. The ring of claim 1, wherein the inner annular body is machined after the injection molding process forming the inner annular body to remove material from the inner annular body such that longitudinal ends of the inner annular body do not extend beyond corresponding longitudinal ends of the outer annular body and the inner annular body is rounded from the outer surface of the inner annular body to the inner surface of the inner annular body.

4. The ring of claim 1, wherein the inner annular body comprises a groove corresponding to the portion of the inner annular body that extends between the first segment and the second segment.

5. The ring of claim 1, wherein:

the outer annular body has a fastening channel defined therein;

the fastening channel is recessed from the inner surface of the outer annular body; and the inner annular body extends into the fastening channel.

6. The ring of claim 1, wherein:

the outer annular body has a fastening channel defined therein;

the fastening channel is recessed from the inner surface of the outer annular body; and the inner annular body substantially fills the fastening channel.

7. The ring of claim 1, wherein:

the outer annular body has a fastening channel defined therein;

the fastening channel is recessed from the inner surface of the outer annular body;

the inner annular body substantially fills the fastening channel; and the outer annular body has a larger diameter in the fastening channel than at the inner surface of the outer annular body.

8. The ring of claim 1, wherein the inner annular body is formed from silicone.

9. The ring of claim 1, wherein the inner annular body comprises at least one of polyvinyl chloride, thermoplastic polyurethane, or silicone.

10. The ring of claim 1, wherein the inner annular body comprises a plurality of slots defined in the inner surface of the inner annular body, at least one slot in the plurality of slots extending longitudinally between a first side of the ring and a second side of the ring.

11. The ring of claim 1, further comprising additional slots that—either directly, or indirectly with the plurality of slots—extend longitudinally from a first side of the ring to a second side of the ring.

12. A ring configured to be worn by a user comprising:

an outer annular body that (a) comprises gold, titanium, carbon fiber, or stainless steel; and (b) comprises at least a first segment and a second segment that is physically distinct from the first segment; and an inner annular body that is attached to an inner surface of the outer annular body; the inner surface of the inner annular body being configured to contact the user when the ring is worn by the user and comprising a plurality of slots that are interlinked with one another.

13. The ring of claim 12, wherein the inner annular body is formed from silicone.

14. The ring of claim 12, wherein the inner annular body is formed via an injection molding process.

15. The ring of claim 12, wherein the outer annular body has a fastening channel defined therein, the fastening channel is recessed from the inner surface of the outer annular body, and the inner annular body extends into the fastening channel.

16. The ring of claim 12, further comprising additional slots that—either directly, or indirectly with the plurality of slots—extend longitudinally from a first side of the ring to a second side of the ring.

17. The ring of claim 12, further comprising at least one additional slot that extends longitudinally to a first side of the ring and couples with at least one slot in the plurality of slots.

18. A ring configured to be worn by a user comprising:

an outer annular body; and an inner annular body formed via an injection molding process, wherein:

an outer surface of the inner annular body is attached to an inner surface of the outer annular body; and an inner surface of the inner annular body is configured to contact the user when the ring is worn by the user and comprises a plurality of slots that are interlinked with one another;

wherein, the outer annular body comprises, in an inner surface of the outer annular body, a first strain relief recess and a second strain relief recess;

the first strain relief recess and the second strain relief recess disposed at an angle relative to each other and to a longitudinal axis through a center of the ring; and the inner annular body extends into the first and second strain relief recesses in the outer annular body.

* * * * *